US008121511B2

(12) United States Patent
Nosaki

(10) Patent No.: US 8,121,511 B2
(45) Date of Patent: Feb. 21, 2012

(54) IMAGE FORMING APPARATUS AND OPERATION SYSTEM FOR IMAGE FORMING APPARATUS

(75) Inventor: Takefumi Nosaki, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/845,941

(22) Filed: Jul. 29, 2010

(65) Prior Publication Data

US 2010/0290801 A1 Nov. 18, 2010

Related U.S. Application Data

(63) Continuation of application No. 12/044,071, filed on Mar. 7, 2008, now Pat. No. 7,787,796.

(60) Provisional application No. 60/912,204, filed on Apr. 17, 2007.

(51) Int. Cl.
*G03G 15/00* (2006.01)

(52) U.S. Cl. ..... 399/88

(58) Field of Classification Search ..... 399/70, 399/80–82, 85, 88

See application file for complete search history.

(56) References Cited

U.S. PATENT DOCUMENTS 7,076,673 B2 * 7/2006 Yoshikawa ..... 713/300

FOREIGN PATENT DOCUMENTS

JP 2005-032397 2/2005
JP 2005-288971 10/2005

OTHER PUBLICATIONS

U.S. Patent Office Action dated Dec. 1, 2009 corresponding to U.S. Appl. No. 12/044,071, filed on Mar. 7, 2008.

* cited by examiner

*Primary Examiner* — Hoang Ngo
(74) *Attorney, Agent, or Firm* — Turocy & Watson, LLP

(57) ABSTRACT

The present invention includes a plurality of image forming apparatuses connected to a network, and a server which controls the operation state of the image forming apparatuses via the network. The image forming apparatuses are operable in a normal operation mode and in one of plural power-saving modes with different power consumption. The server individually sets the operation mode of the image forming apparatuses in accordance with a preset power-saving operation policy, and controls the image forming apparatuses so that each of the image forming apparatuses operates in the preset operation mode in each predetermined time band.

17 Claims, 10 Drawing Sheets

FIG.2

NUMBER OF UNITS

| NO. | CLASS / TIME MAND | A | B1 | B2 | B3 | C | D |
|---|---|---|---|---|---|---|---|
| 1 | 00:00～08:00 | 8 | 0 | 2 | 0 | 0 | 0 |
| 2 | 08:00～12:00 | 0 | 0 | 0 | 0 | 0 | 10 |
| 3 | 12:00～13:00 | 5 | 0 | 0 | 3 | 2 | 0 |
| 4 | 13:00～17:00 | 0 | 0 | 0 | 0 | 0 | 10 |
| 5 | 17:00～19:00 | 5 | 0 | 0 | 3 | 2 | 0 |
| 6 | 19:00～24:00 | 8 | 0 | 0 | 2 | 0 | 0 |

FIG.3

MFP101

| NO. | CLASS / TIME BAND | A | B1 | B2 | B3 | C | D |
|---|---|---|---|---|---|---|---|
| 1 | 00:00～08:00 | | | ◎ | | | |
| 2 | 08:00～12:00 | | | | | | ◎ |
| 3 | 12:00～13:00 | | | | | ◎ | |
| 4 | 13:00～17:00 | | | | | | ◎ |
| 5 | 17:00～19:00 | | | | | ◎ | |
| 6 | 19:00～24:00 | | | | ◎ | | |

18
181
FAX-CPU
182
NCU
183
111
CPU
112
KEYS
113
LCD
114
BACKLIGHT
115
TOUCH PANEL
11
204
203
14
142
DRAM
141
CPU
143
PHY
144
ASIC
300
HDD
19
204
145
201
202
POWER-SUPPLY UNIT
20
101
FINISHER
17
PRINTER UNIT
16
FIXING DEVICE
161
SCANNER UNIT
15
202
ADF
12

FIG.5

MFP101

| CLASS/ OPERATION MODE | | CPU 141 | HDD 19 | CONTROL PANEL 11 | NIC-PHY 143 | SCANNER 15 | PRINTER 16 | FIXING DEVICE 161 | FAX-CPU 181 | NCU 182 |
|---|---|---|---|---|---|---|---|---|---|---|
| A | AO | SLEEP | OFF | OFF | OFF | OFF | OFF | OFF | OFF | OFF |
| B1 | :PL | SLEEP | OFF | BACKLIGHT OFF | OFF | OFF | OFF | OFF | OFF | OFF |
| B2 | PM | SLEEP | ROTATION STOP | BACKLIGHT OFF | ON | OFF | OFF | OFF | SLEEP | ON |
| B3 | PH | SLEEP | ROTATION STOP | BACKLIGHT OFF | ON | SLEEP | SLEEP | OFF | SLEEP | ON |
| C | N | FULL OPERATION | ROTATION STOP | BACKLIGHT OFF | ON | READY | READY | LOW TEMP. | READY | ON |
| D | F | FULL OPERATION | FULL OPERATION | FULL OPERATION | ON | READY | READY | READY | READY | ON |

FIG.6

P1

MFP101

| POWER SAVE POLICY-SET | POWER SAVE CLASS-B2 | NORMAL-1 MODE-F 08:00～12:00 | NORMAL-2 MODE-F 13:00～17:00 | POWER SAVE-1 MODE-N 12:00～13:00 | POWER SAVE-2 MODE-N 17:00～19:00 | POWER SAVE-3 MODE-PH 19:00～24:00 | POWER SAVE-4 MODE-PM 00:00～08:00 | POWER SAVE-END CHECKSUM |
|---|---|---|---|---|---|---|---|---|
| d11 | d12 | d13 | d14 | d15 | d16 | d17 | d18 | d19 |

FIG.10

MFP10m

| NO. | CLASS / TINE BAND | A | B1 | B2 | B3 | C | D |
|---|---|---|---|---|---|---|---|
| 1 | 00:00～08:00 | ◎ | | | | | |
| 2 | 08:00～12:00 | | | | | | ◎ |
| 3 | 12:00～13:00 | | | | ◎ | | |
| 4 | 13:00～17:00 | | | | | | ◎ |
| 5 | 17:00～19:00 | | | | ◎ | | |
| 6 | 19:00～24:00 | ◎ | | | | | |

FIG.11

MFP10m / MFP10n

| CLASS/ OPERATION MODE | | CPU 141 | HDD 19 | CONTROL PANEL 11 | NIC-PHY 143 | SCANNER 15 | PRINTER 16 | FIXING DEVICE 161 |
|---|---|---|---|---|---|---|---|---|
| A | AO | SLEEP | OFF | OFF | OFF | OFF | OFF | OFF |
| B1 | :PL | SLEEP | OFF | BACKLIGHT OFF | OFF | OFF | OFF | OFF |
| B2 | PM | SLEEP | ROTATION STOP | BACKLIGHT OFF | ON | OFF | OFF | OFF |
| B3 | PH | SLEEP | ROTATION STOP | BACKLIGHT OFF | ON | SLEEP | SLEEP | OFF |
| C | N | FULL OPERATION | ROTATION STOP | BACKLIGHT OFF | ON | READY | READY | LOW TEMP. |
| D | F | FULL OPERATION | FULL OPERATION | FULL OPERATION | ON | READY | READY | READY |

FIG.12

P4

MFP10m

| POWER SAVE POLICY-SET | POWER SAVE CLASS-A | NORMAL-1 MODE-F 08:00～12:00 | NORMAL-2 MODE-F 13:00～17:00 | POWER SAVE-1 MODE-PH 12:00～13:00 | POWER SAVE-2 MODE-PH 17:00～19:00 | POWER SAVE-3 MODE-AO 19:00～24:00 | POWER SAVE-4 MODE-AO 00:00～08:00 | POWER SAVE-END CHECKSUM |
|---|---|---|---|---|---|---|---|---|

FIG.15

MFP10n

| NO. | TIME BAND \ CLASS | A | B1 | B2 | B3 | C | D |
|---|---|---|---|---|---|---|---|
| 1 | 00:00～08:00 | ◎ | | | | | |
| 2 | 08:00～12:00 | | | | | | ◎ |
| 3 | 12:00～13:00 | ◎ | | | | | |
| 4 | 13:00～17:00 | | | | | | ◎ |
| 5 | 17:00～19:00 | ◎ | | | | | |
| 6 | 19:00～24:00 | ◎ | | | | | |

FIG.16

P5

MFP10n

| POWER SAVE POLICY-SET | POWER SAVE CLASS-A | NORMAL-1 MODE-F 08:00～12:00 | NORMAL-2 MODE-F 13:00～17:00 | POWER SAVE-1 MODE-AO 12:00～13:00 | POWER SAVE-2 MODE-AO 17:00～24:00 | POWER SAVE-4 MODE-AO 00:00～08:00 | POWER SAVE-END CHECKSUM |
|---|---|---|---|---|---|---|---|

IMAGE FORMING APPARATUS AND OPERATION SYSTEM FOR IMAGE FORMING APPARATUS

CROSS REFERENCE TO RELATED APPLICATIONS

This application is a Continuation of application Ser. No. 12/044,071 filed on Mar. 7, 2008, the entire contents of which are incorporated herein by reference.

This application is based upon and claims the priority of U.S. Provisional Application No. 60/912,204, filed on Apr. 17, 2007, the entire contents of which are incorporated herein by reference.

BACKGROUND OF THE INVENTION

1. Field of the Invention

The present invention relates to an image forming apparatus that is connectable to a network, and an operation system and an operation method which realize power saving of the image forming apparatus.

2. Description of the Related Art

An image forming apparatus, for example, a digital multi-function machine called MFP (multi-function peripherals), has a scanner unit and a printer unit. A document is read by the scanner unit. The read image data is processed by an image processing unit. The image is printed by the printer unit.

Some of the recent digital multi-function peripherals have a facsimile function using a public line, as well as a copy and scanner functions. Some of the digital multi-function peripherals also have plural functions such as connecting to a network and getting linked to an external computer (for example, a personal computer), inputting print data from the external computer, and printing the data.

Such digital multi-function peripherals have taken various measures to reduce power consumption. For example, JP-A-2005-288971 discloses an image forming apparatus in which the time for shifting to a sleep state or a ready state can be preferentially set by user operation. However, in this example, the time of power-saving operation is set by the user and only simple settings can be provided.

JP-A-2005-32397 discloses a power saving control method. In this example, the state of power in plural image forming apparatuses connected to a network is centrally controlled by using a power saving server. However, in this example, it is determined whether the total value of power consumption by the image forming apparatuses exceeds a target value or not, and the overall power consumption of the system is reduced. This technique has a problem that the overall control algorithm is inflexible and has a low degree of freedom.

SUMMARY OF THE INVENTION

It is an object of the invention to provide an image forming apparatus that can be operate in a normal mode and in a power-saving mode and in which the operation in the power-saving mode can be set more in detail, and an operation system for the image forming apparatus.

According to an aspect of the present invention, there is provided an operation system for an image forming apparatus comprising; a plurality of image forming apparatuses connected to a network, and a server which controls operation state of the plural image forming apparatuses via the network. The image forming apparatuses are operable in a normal operation mode and in one of plural power-saving modes with different power consumption. The server individually sets the operation mode of the image forming apparatuses in accordance with a preset power-saving operation policy, and controls the image forming apparatuses so that each of the image forming apparatuses operates in the preset operation mode in each predetermined time band.

DESCRIPTION OF THE DRAWINGS

FIG. 2 is an explanatory view showing exemplary operation of image forming apparatuses in the operation system according to the embodiment of the invention.

FIG. 3 is an explanatory view showing an exemplary operation mode of an image forming apparatus in the operation system according to the embodiment of the invention.

FIG. 5 is an explanatory view showing exemplary operation state of the image forming apparatus according to the embodiment of the invention.

FIG. 6 is an explanatory view showing an exemplary setting packet sent from an operation server according to the embodiment of the invention.

FIG. 10 is an explanatory view showing another exemplary operation mode of the image forming apparatus according to the embodiment of the invention.

FIG. 11 is an explanatory view showing another example of operation state of the image forming apparatus according to the embodiment of the invention.

FIG. 12 is an explanatory view showing another exemplary setting packet set from the operation server according to the embodiment of the invention.

FIG. 15 is an explanatory view showing still another exemplary operation mode of the image forming apparatus according to the embodiment of the invention.

FIG. 16 is an explanatory view showing still another exemplary setting packet sent from the operation server according to the embodiment of the invention.

DETAILED DESCRIPTION OF THE INVENTION

Figure 1:
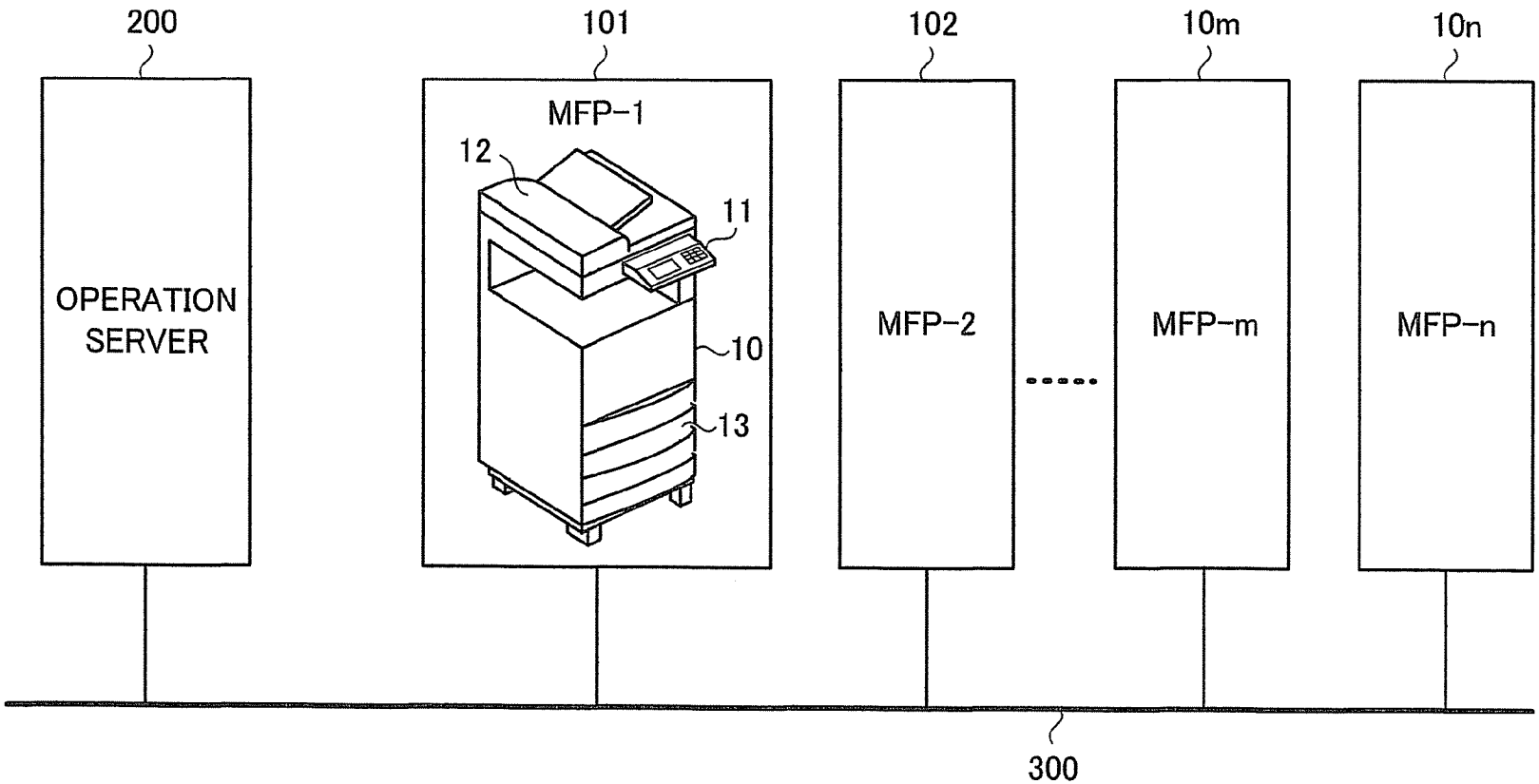
FIG. 1 is a network configuration view showing an operation system for image forming apparatuses according to an embodiment of the invention.

Throughout this description, the embodiments and examples shown should be considered as exemplars, rather than limitations on the apparatus of the present invention.

Hereinafter, an embodiment of the invention will be described in detail with reference to the drawings. In the drawings, the same parts and components are denoted by the same reference numerals.

FIG. 1 is a network configuration view showing an operation system for image forming apparatuses according the first embodiment of the invention.

In the system of FIG. 1, plural image forming apparatuses 101, 102, . . . 10*n* indicated as MFP-1, MFP-2, . . . MFP-n, and an operation server 200 are connected with each other via a network 300 including LAN or the like.

The image forming apparatuses 101, 102, . . . 10*n* are, for example, digital multi-function machines called MFPs (multi-function peripherals). Hereinafter, the image forming apparatuses 101, 102, . . . 10*n* may also be referred to as MFPs.

The operation server 200 centrally manages the operation mode of the MFPs 101, 102, . . . 10*n* and causes each MFP to operate with power saving.

The outer structure of the image forming apparatuses 101, 102, . . . 10*n* will be described, taking the MFP 101 as a typical example. There is a document table at the top of a body 10 of the MFP 101. A control panel 11 is provided near the document table. Also, an automatic document feeder (ADF) 12 is provided on the document table in such a manner that the ADF can freely open and close.

A scanner unit and a printer unit are provided within the body 10. Moreover, plural cassettes 13 having sheets of various sizes housed therein are provided at the bottom of the body 10. The internal configuration of the body 10 will be described later with reference to FIG. 4. If a finisher is connected to the body 10, staple processing, punching processing (hole punching) and the like can be performed to sheets discharged from the body 10.

The operation server 200 controls the operation mode of each of the MFPs 101, 102, . . . 10*n* via the network 300 and causes the MFPs 101, 102, . . . 10*n* to operate with power saving, for example, according to an exemplary operation as shown in FIG. 2.

In FIG. 2, it is assumed that ten MFPs are connected to the network 300. The number of operable MFP units is set for each time band, and the power saving class (of classes A to D) of the MFP operating in each time band is set. In FIG. 2, the vertical axis represents time band and the horizontal axis represents power saving class. The numeric values in the matrix express the number of MFP units that are operable in each time band.

For example, in the time band of 0:00-08:00, eight MFPs are operable in class A and two MFPs are set to be operable in class B2. In the time band of 08:00-12:00, all the ten MFPs are set to be operable in class D. In the time band of 12:00-13:00, five MFPs are operable in class A, three MFPs are operable in class B3, and two MFPs are set to be operable in class C.

In the time band of 13:00-17:00, all the ten MFPs are set to be operable in class D. In the time band of 17:00-19:00, five MFPs are operable in class A, three MFPs are operable in class B3, and two MFPs are set to be operable in class C. In the time band of 19:00-24:00, eight MFPs are operable in class A and two MFPs are set to be operable in class B3.

In this manner, the operation server 200 carries out rating (classification) for power saving in each time band in accordance with the frequency of use of the MFPs, and thus provides settings that improve operation efficiency with power saving by minimizing the resulting inconvenience of the MFPs.

There are, for example, six power saving classes, that is, class A, class B1, class B2, class B3, class C and class D. Class A has the highest degree of power saving, and class D has the lowest degree of power saving. The classes are described as follows.

Class A: The degree of power saving is the highest of all the classes. This is close to the all-off state. That is, in a set time band, the power saving mode (sleep mode) is continued even when there is an access from the user. The set time band applies from late at night to dawn (for example, 0:00-08:00). Hereinafter, the operation mode of the MFP in class A is referred to as mode AO.

Class B1: The degree of power saving is lower than class A. This is the state of low power consumption with power saving. That is, in a set time band, the power saving mode is canceled when the user has accessed the control panel 11. An access to the MFP via the network is ignored. Hereinafter, the operation mode of the MFP in class B1 is referred to as mode PL.

Class B2: The degree of power saving is lower than class B1. This is the state of middle power consumption with power saving. That is, in a set time band, the power saving mode is canceled when the user has accessed the control panel 11. When the MFP is accessed via the network, response is allowed. However, the operation of mechanical elements (print operation or the like) of the MFP is not allowed. Hereinafter, the operation mode of the MFP in class B2 is referred to as mode PM.

Class B3: The degree of power saving is lower than class B2. This is the state of high power consumption with power saving. That is, in a set time band, the power saving mode is canceled when the user has accessed the control panel 11. When there is an access via the network, response is allowed. Also the print operation is allowed. Hereinafter, the operation mode of the MFP in class B3 is referred to as mode PH.

Class C: This is the state in which the degree of power saving is lower than class B3. That is, in a set time band, the normal state is immediately restored when there is an access from the user. Hereinafter, the operation mode of the MFP in class C is referred to as mode N.

Class D: This is the full-operation state with no power-saving operation. Its set time band applies to, for example, working hours (08:00-12:00, 13:00-17:00). Hereinafter, the operation mode of the MFP in class D is referred to as mode F.

The remaining time bands except for the set time bands of class A and class D are applied to classes B1, B2, B3 and C.

In this manner, the operation server 200 sets the number of operable MFP units in accordance with the time band where the MFPs are used at a high rate and the time band where the MFPs are used at a low rate, and sets the power saving class of the MFPs in each time band, thereby managing power saving.

FIG. 3 is a view showing an exemplary operation mode set for the MFP 101. In FIG. 3, the vertical axis represents time band and the horizontal axis represents power saving class of the MFP 101. The circles in the matrix represent the power saving class in which the MFP 101 operates at the time.

For example, the MFP is set to operate in class B2 in the time band of 0:00-08:00, and to operate in class D in the time band of 08:00-12:00. Subsequently, the MFP is set to operate in class C in the time band of 12:00-13:00, in class D in the time band of 13:00-17:00, in class C in the time band of 17:00-19:00, and in class B3 in the time band of 19:00-24:00.

Figure 4:
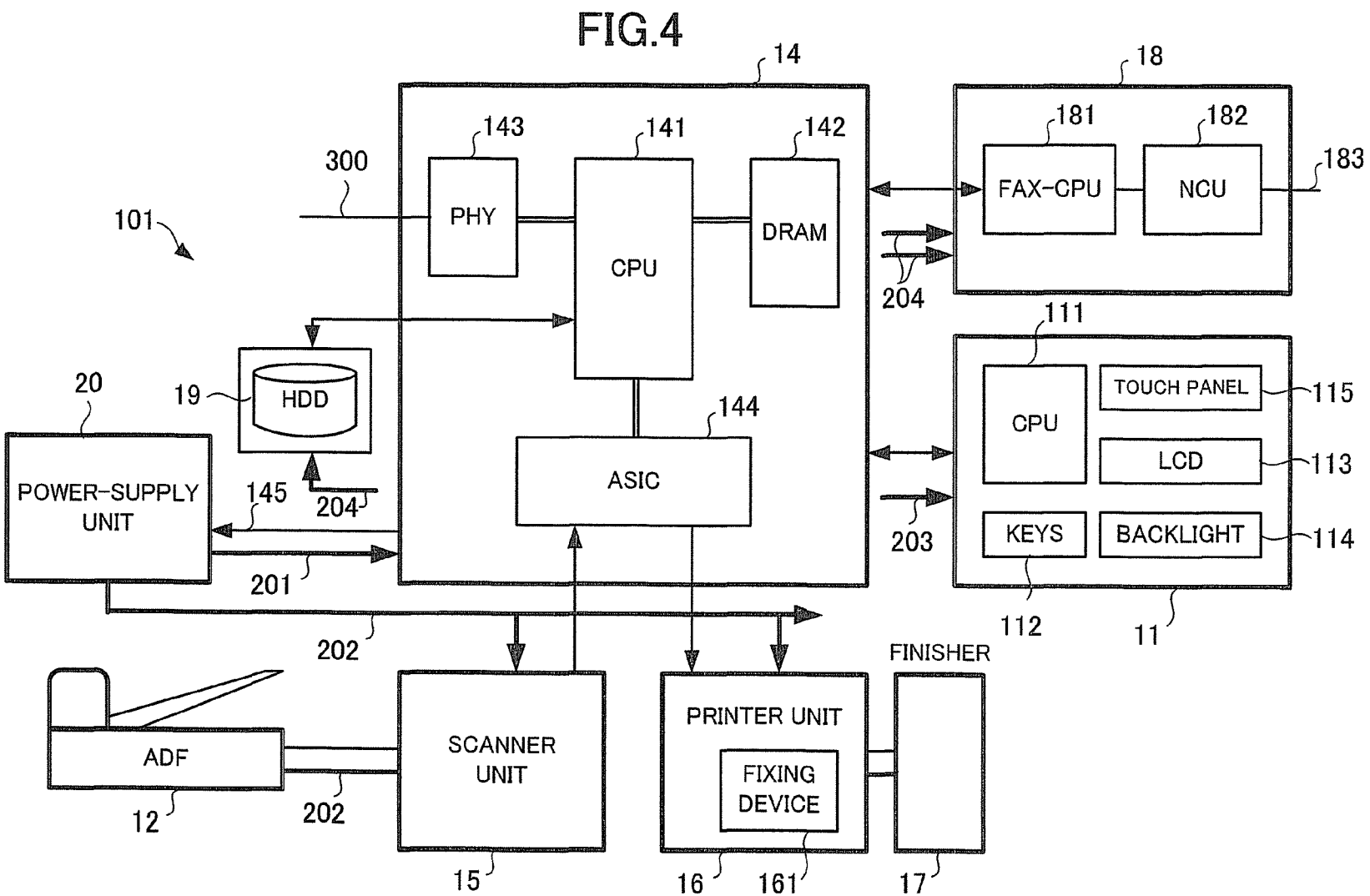
FIG. 4 is a block diagram showing a configuration of the image forming apparatus according to the embodiment of the invention.

FIG. 4 is a block diagram showing an exemplary internal configuration of the MFP 101 that is operable in each of the above classes.

In FIG. 4, the MFP 101 has the control panel 11, the ADF 12, a main control unit 14, a scanner unit 15, and a printer unit 16. A finisher 17 is provided next to the printer unit 16. The MFP 101 also has a FAX unit 18, a hard disk drive (HDD) 19, which is a memory unit, and a power-supply unit 20.

The control panel 11 includes a panel CPU 111, various operation keys 112, a display unit 113 made of liquid crystal or the like, a liquid crystal backlight 114, and a touch panel 115 integrated with the display unit 113. The operation keys 112 are used to input various instructions such as the number of copies to be printed. The display unit 113 shows various displays.

The main control unit 14 includes a CPU 141, a DRAM 142, a network interface 143, and an ASIC (application specified IC) 144. The HDD 19, which is controlled by the CPU 141, is connected to the main control unit 14. The scanner unit 15 and the printer unit 16 are connected to the ASIC 144. Moreover, the control panel 11 and the FAX unit 18 are connected to the main control unit 14.

The CPU 141 is to control the overall operation of the MFP 101. The DRAM 142 is to store various data. The network interface 143 has a PHY (physical layer device) that carries out physical layer processing on the network. The network interface 143 converts packet data transmitted through the network 300 to digital data and takes the digital data into the MFP 101. The network interface 143 also converts digital data from the MFP 101 to electric signals and outputs the electric signals to the network 300.

The ASIC 144 compresses image data read by the scanner unit 15 and stores the compressed image data to HDD 19. The ASIC 144 also reads out image data stored in the HDD 19, expands the image data, performs predetermined image processing (graduation reproduction or the like), and outputs the processed image data to the printer unit 16.

Storing image data to the HDD 19 and reading image data from the HDD 19 are carried out under the control of the CPU 141. The scanner unit 15 operates together with the ADF 12 and sequentially reads each sheet of a document fed by the ADF 12. The scanner 15 may also directly read the document set on the document table.

The printer unit 16 includes a photoconductive drum, a laser and the like. The surface of the photoconductive drum is scanned with a laser beam from the laser and exposed to light. An electrostatic latent image is thus created on the photoconductive drum. A charger, a developing device, and transfer device are arranged around the photoconductive drum. The electrostatic latent image on the photoconductive drum is developed by the developing device and a toner image is formed on the photoconductive drum. The toner image is transferred to a sheet by the transfer device.

The printer unit 16 also has a fixing device 161. The sheet P to which the toner image has been transferred is carried to the fixing device 161. In the fixing device 161, for example, a heating roller and a pressurizing roller are arranged to face each other. As the sheet is passed between the heating roller and the pressurizing roller, the toner image transferred to the sheet is fixed onto the sheet.

The ADF 12, the scanner unit 15, the printer unit 16 and the HDD 19 serve to form an image on a sheet in response to the operation on the control panel 11. These units form an image forming unit. The configuration of the printer unit 16 is not limited to the above example and various systems have been known.

The sheet on which the toner image has been fixed is discharged from the printer unit 16 and sent to the finisher 17. The finisher 17 performs post-processing of the printed sheet discharged from the printer unit 16, for example, punching processing, sorting processing, staple processing and the like.

The FAX unit 18 is to send and receive data via a line 183, and has a FAX-CPU 181 and an NCU (network control unit) 182.

The power-supply unit 20 is to supply various power-supply voltages to the units in the MFP 101. The power-supply unit 20 has four types of power-supply systems, that is, power lines 201, 202, 203 and 204.

On the power line 201, a power-supply voltage is continuously provided while the power switch is on. On the power lines 202, 203 and 204, a power-supply voltage that is on-off controlled by a control line 145 from the main control unit 14 is provided.

The power-supply voltage from the power line 201 is supplied to the main control unit 14. The power-supply voltage from the power line 202 is supplied to the scanner unit 15, the printer unit 16, the finisher 17 and the like. The power-supply voltage from the power line 203 is supplied to the control panel 11. The power-supply voltage from the power line 204 is supplied to the FAX unit 18 and the HDD 19.

FIG. 5 is a view for explaining the operation state of each unit of the MFP in the case where the MFP 101 is caused to operate in classes A to D.

For example, class A (operation mode AO) is described an exemplary case. The CPU 141 of the main control unit 14 is in the sleep state. The HDD 19, the entire control panel 11, the PHY 143, the scanner unit 15, the printer unit 16, the fixing device 161, the FAX-CPU 181 and the NCU 182 are in the off state.

Class A (operation mode AO) is the mode with the least power consumption. It is the mode in which the CPU 141 has been set in the sleep operation by an internal timer and can be restored at the time decided by the timer operation.

In class B1 (operation mode PL), compared to class A, the power line 203 is supplying power and the control panel 11 is supplied with power though the backlight 114 in the control panel 11 is off. Therefore, in class B1, the CPU 141 is in the sleep state, but when the user has operated the control panel 11, the CPU 141 can restore its operation state according to the user's operation.

In class B2 (operation mode PM), compared with class B1, the power line 204 is supplying power, the HDD 19 has stopped rotating, and the PHY 143 is on. The FAX-CPU 181 is in the sleep state and the NCU 182 is on. Class B2 is the mode in which status response to a network access and FAX reception are possible even when the machines (scanner unit 15 and printer unit 16) are off. In this case, the HDD 19 has stopped rotating, but the HDD 19 can restore the normal state when necessary, and can save data.

In class B3 (operation mode PH), compared with class B2, the power line 202 is supplying power, and the scanner unit 15 and the printer unit 16 are in the sleep state. In class B3, data reception from the network and FAX reception are possible. As the user operates the control panel 11, the scanner unit 15 and the printer unit 16 restore the state where printing and scanning of an original can be carried out.

In class C (operation mode N), compared with class B3, the CPU 141 is in the full-operation state, and the scanner unit 15, the printer unit 16 and the FAX-CPU 181 are in the ready state. The fixing device 161 is in the low-temperature state. In class C, the temperature setting of the fixing device 161 is controlled to be lower than usual, but the fixing device 161 can restore the normal state within several ten seconds.

In class D (operation mode F), the CPU 141, the HDD 19 and the control panel 11 are in the full-operation state. The PHY 143 and the NCU 182 are on. The scanner unit 15, the printer unit 16, the fixing device 161 and the FAX-CPU 181 are in the ready state. In class D, each unit of the MFP 101 is in the usual ready state and can start operating at any time.

In this manner, the electrifying state of the main control unit 14, the control panel 11, the scanner unit 15, the printer unit 16, the HDD 19 and the like is controlled to the on, off, sleep or ready state. Thus, the operation mode in each power saving class can be arbitrarily set.

In FIG. 5, in the operation modes in the upper rows, power consumption is little but the restoration to the normal state takes time, whereas in the operation modes in the lower rows, power consumption is large but the time for restoring to the normal state is short.

Since the MFP 101 shown in FIG. 4 has the FAX unit 18, FAX reception may happen at night. Therefore, the MFP 101 cannot be made completely off even at night. At least the NCU 182, which is the interface to the line 183, must be kept on and also the FAX-CPU 181 must be kept in the sleep state, in which the FAX-CPU 181 can start on receiving from the line. Therefore, classes B3 and B2 are set in the time bands of 19:00-24:00 and 00:00-08:00, as shown in FIG. 3.

FIG. 6 is a view showing an example of a setting packet P1 sent from the operation server 200 to the MFP 101 when the MFP 101 is set to the state of FIG. 3.

In FIG. 6, the leading data d11 is data that set a power-saving operation policy. The next data d12 is data that designates the overall operation class of the MFP 101. The subsequent data d13 to d18 are data that designate the operation mode in each time band. The last data d19 is data representing the end of setting and includes check sum data to check whether data has been correctly transmitted or not.

The operation server 200 requests a report from the MFP 101 in order to confirm whether the MFP 101 has operated according to the setting or not.

Figure 7A:
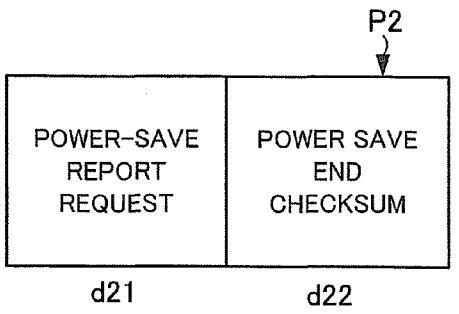
FIG. 7A is an explanatory view showing an exemplary report request packet sent from the operation server according to the embodiment of the invention.

FIG. 7A shows a report request packet P2 sent from the operation server 200 to the MFP 101. This is a packet with which the operation server 200 makes an inquiry to the MFP 101 as to whether the MFP 101 has operated according to the operation setting shown in FIG. 3 and FIG. 5. The report request packet P2 includes data d21 that requests a report and check sum data d22 to check whether data has been correctly transmitted or not.

Figure 7B:
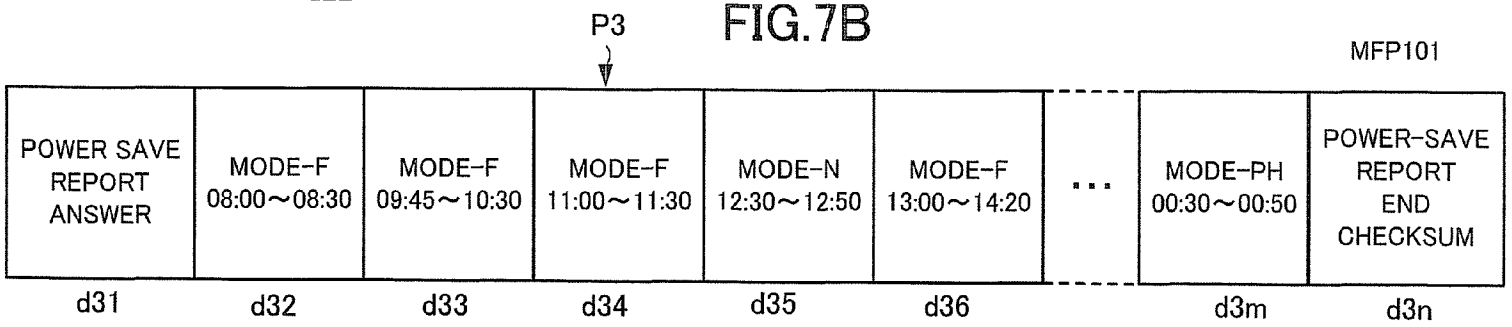
FIG. 7B is an explanatory view showing an exemplary answer packet sent from the image forming apparatus according to the embodiment of the invention.

Meanwhile, the MFP 101 having received the report request packet P2 sends back an answer packet P3 shown in FIG. 7B to the operation server 200.

FIG. 7B shows an example of the answer packet P3 sent from the MFP 101 to the operation server 200.

In FIG. 7B, the packet d31 includes reply start data and the packets d32 to d3*m* include data representing the operation mode by time in the case where the MFP 101 actually operates. The last packet p3*n* includes check sum data to check whether data has been correctly transmitted or not.

Figure 8:
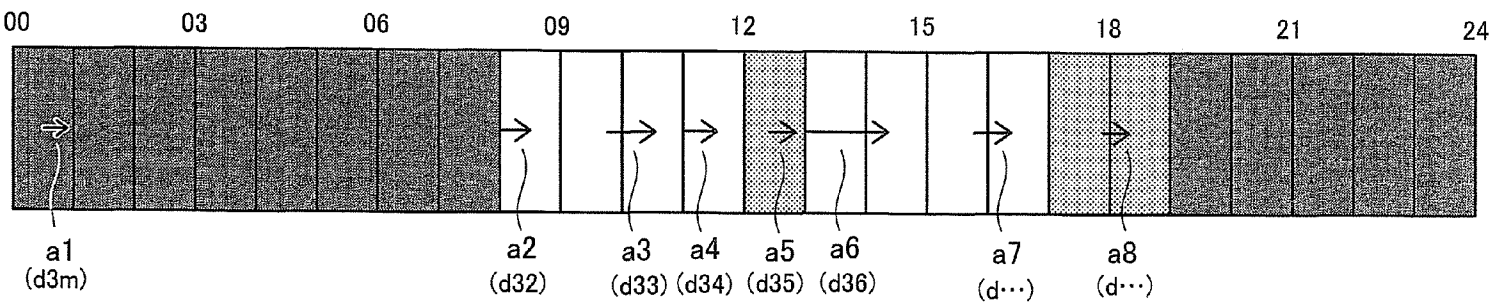
FIG. 8 is an explanatory view showing an example of actual operation status of the image forming apparatus according to the embodiment of the invention.

FIG. 8 is a view showing the actual operation status of the MFP 101. The horizontal axis represents time. The sections containing arrows a1 to a8 represent time bands in which the MFP 101 has actually operated. In FIG. 8, darker color represents less power consumption and lighter color represent greater power consumption.

The operation status shown in FIG. 8 is created by the operation server 200 on the basis of the data of the answer packet P3 of FIG. 7B and displayed on a monitor. Practically, the operation status is subdivided. Since the answer packet P3 has a large volume of data, the data is grouped into 10-minute units or the like and collectively sent back, thus reducing the transmitted data.

In this manner, the operation server 200 gathers the actual operation status data and can grasp the actual operation status of each MFP. Moreover, the operation setting can be changed when necessary, and further power saving can be thus realized.

It is desired that the operation mode information from the MFPs 101 to 10*n* should be collectively sent back at the time when all the MFPs can send and receive data.

Figure 9:
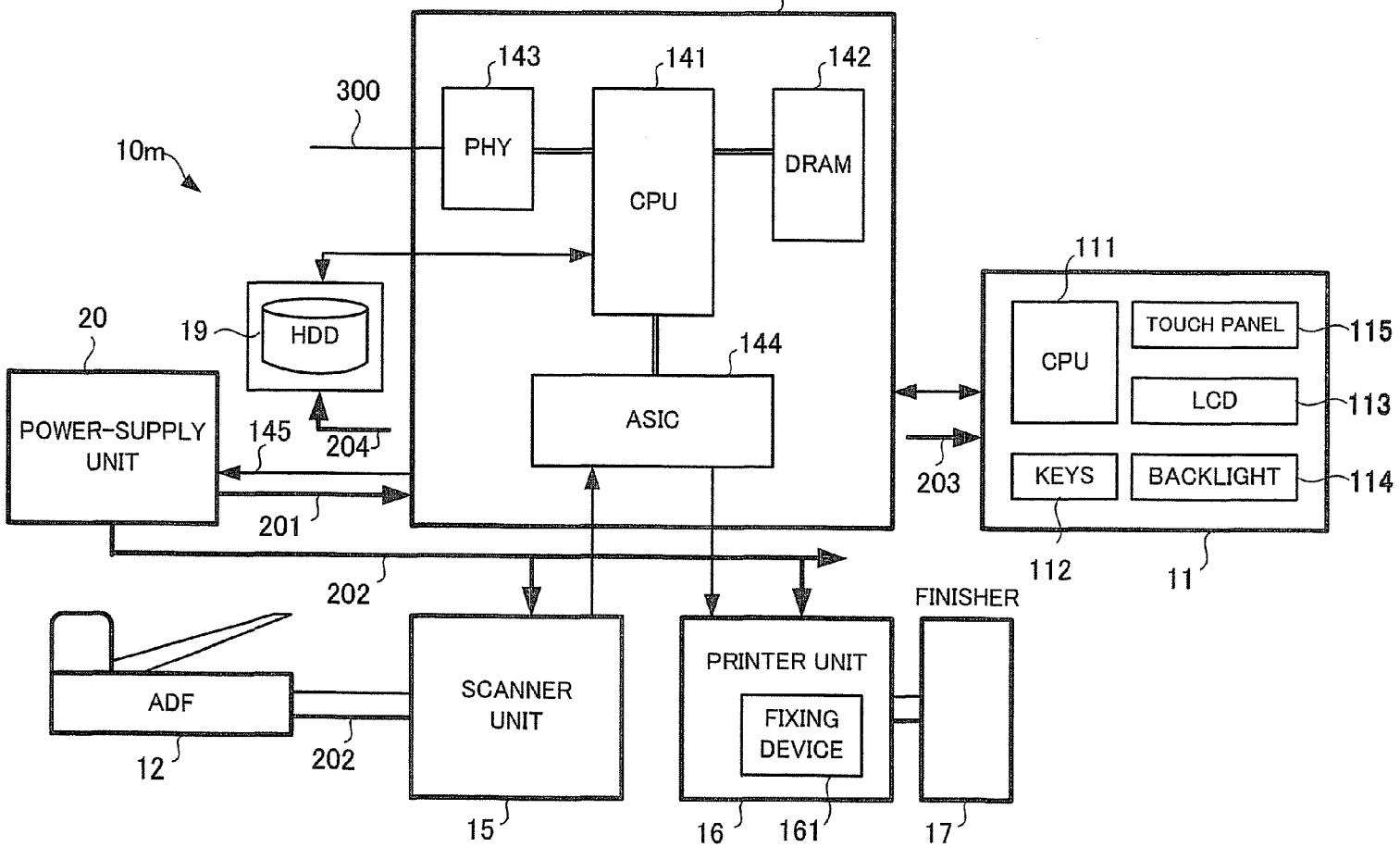
FIG. 9 is a block diagram showing another configuration of the image forming apparatus according to the embodiment of the invention.

FIG. 9 is a block diagram showing the configuration of another MFP. FIG. 9 shows the configuration of the MFP 10*m*. In this example, the MFP 10*m* has no FAX communication function and therefore does not have the FAX unit 18, compared to the MFP 101 of FIG. 4. The other parts of the MFP 10*m* are the same as the configuration shown in FIG. 4.

For this MFP 10*m*, the operation server 200 sets an operation mode, for example, as shown in FIG. 10. In FIG. 10, the vertical axis represents time band and the horizontal axis represents power saving class of the MFP 10*m*. The circles in the matrix indicate that the MFP 10*m* is operable.

FIG. 11 is a view for explaining the operation state of each part of the MFP 10*m* in the case where the MFP 10*m* is caused to operate in classes A to D. Compared to the example of FIG. 5, the operation states of the FAX-CPU 181 and the NCU 182 are not shown.

FIG. 12 is a view showing an example of a setting packet P4 sent from the operation server 200 to the MFP 10*m* when the MFP 10*m* is set to the state of FIG. 10.

Figure 13:
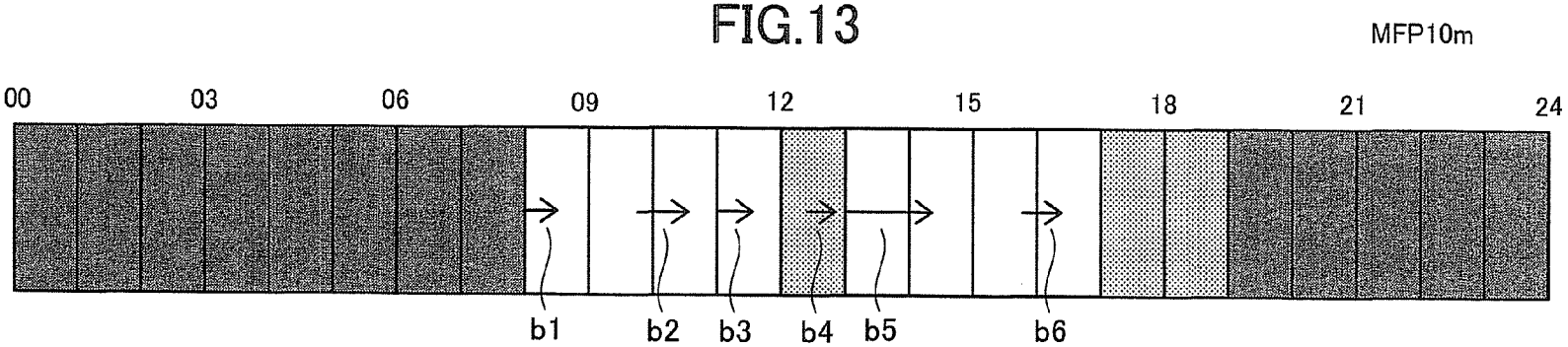
FIG. 13 is an explanatory view showing another example of actual operation status of the image forming apparatus according to the embodiment of the invention.

FIG. 13 is a view showing the actual operation status of the MFP 10*m*. The horizontal axis represents time. The sections containing arrows b1 to b6 represent time bands in which the MFP 10*m* has actually operated. The operation status shown in FIG. 13 is created by the operation server 200 on the basis of the data of an answer packet (similar to FIG. 7B) sent from the MFP 10*m* to the operation server 200.

Figure 14:
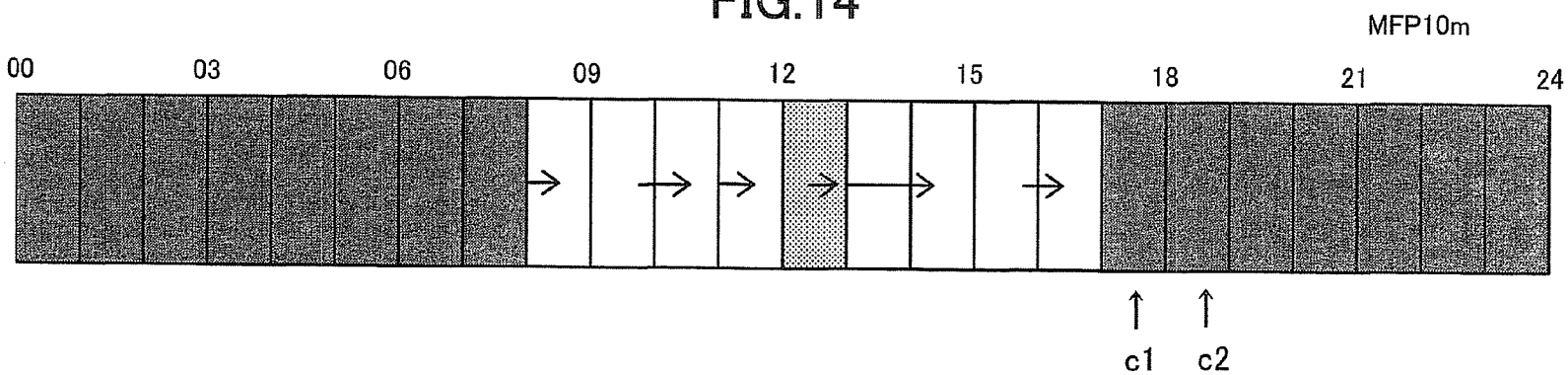
FIG. 14 is an explanatory view showing an exemplary improvement in the operation status of the image forming apparatus according to the embodiment of the invention.

The operation server 200 gathers actual operation status data and thus can grasp the actual operation status of the MFP 10*m*. The power-saving operation policy can be changed when necessary. FIG. 14 is a view showing an example of operation status of the MFP 10*m* after the change.

In the example shown in FIG. 14, the operation mode in the time bands indicated by arrows c1 and c2 is reset to a low power consumption mode so that power consumption is further reduced in the time band of 17:50-18:10.

FIG. 15 shows an exemplary operation mode of another MFP 10*n*. The configuration of the MFP 10*n* is similar, for example, to FIG. 9, and the MFP 10*n* is operable in the operation state as shown in FIG. 11.

The operation server 200 sets an operation mode as shown in FIG. 15 for the MFP 10*n*. In FIG. 15, the vertical axis represents time band and the horizontal axis represents power saving class of the MFP 10*n*. The circles in the matrix indicate the power saving class in which the MFP 10*n* operates at the time.

FIG. 16 is a view showing an example of a setting packet P5 sent from the operation server 200 to the MFP 10*n* when the MFP 10*n* is set to the state of FIG. 15.

As is described above, with the operation system according to the embodiment of the invention, the operation server 200 enables operation of each image forming apparatus in the power saving mode.

Also, by receiving actual operation state and results from plural MFPs, the operation server 200 can review the power-saving operation policy for each MFP. Thus, the number of MFP units to which power-saving operation is applied more strictly can be increased, or conversely, the number of MFP units to which power-saving operation is applied more loosely can be increased. Therefore, more detailed power-saving operation can be realized.

Moreover, the power saving mode of each MFP or image forming apparatus can be manually set and changed by a user, manager or serviceman on the basis of the operation of the operation panel 11, without depending on an instruction from the operation server 200.

It should be understood that the invention should not be limited to the above-described embodiment and that various modifications can be made without departing from the scope of the attached claims.

Although exemplary embodiments of the present invention have been shown and described, it will be apparent to those having ordinary skill in the art that a number of changed, modifications, or alterations to the invention as described herein may be made, none of which depart from the spirit of the present invention. All such changes, modifications, and alterations should therefore be seen as within the scope of the present invention.

What is claimed is:

1. A method for managing a plurality of image forming apparatuses having a plurality of operation modes of different power consumption through an external device, comprising;

setting a number of the image forming apparatuses operating in each time band based on a preset power saving operation policy;

generating a setting information to set the operation mode executed by the image forming apparatuses in each preset time band, for each of the set number of the image forming apparatuses; and transmitting the setting information generated to a corresponding one of the set number of the image forming apparatuses.

2. A method for managing a plurality of image forming apparatuses having a plurality of operation modes of different power consumption through an external device, comprising;

setting a greater number of the image forming apparatuses operating in an operation mode of greater power consumption and the smaller number of the image forming apparatuses operating in an operation mode of smaller power consumption, in a time band when the plurality of the image forming apparatuses are used more frequently;

generating a setting information to set the operation mode executed by the image forming apparatuses in each preset time band, for each of the plurality of the image forming apparatuses; and transmitting the setting information generated to a corresponding one of the image forming apparatuses.

3. The method of claim 1, wherein the plurality of the image forming apparatuses have a plurality of operation modes of smaller and greater power consumption.

4. The method of claim 1, wherein the plurality of the image forming apparatuses have a plurality of operation modes of high and low power saving degrees.

5. The method of claim 1, requesting against the plurality of the image forming apparatuses to report the operation mode of actual operation.

6. The method of claim 1, acquiring a information indicating the operation mode of each of the plurality of the image forming apparatuses in actual operation from each of the image forming apparatuses;

changing the setting information based on the information acquired from the image forming apparatuses; and transmitting the changed setting information to a corresponding one of the image forming apparatuses.

7. The method of claim 1, acquiring the information indicating a operation mode of each of the plurality of the forming apparatuses in actual operation from each of the image forming apparatuses;

changing the number of the image forming apparatuses operating in each time band and the setting information based on the information acquired from the image forming apparatuses; and transmitting each of the changed setting information to the image forming apparatuses changed in number.

8. A computer-readable storage medium which, in order to manage a plurality of image forming apparatuses having a plurality of operation modes of different power consumption, stores a program to execute:

a number setting procedure to set a number of the image forming apparatuses operating in each time band based on a preset power saving operation policy;

a generating procedure to generate a setting information to set the operation mode executed by the image forming apparatuses in each preset time band, for each of the set number of the image forming apparatuses; and a transmitting procedure to transmit the setting information generated to a corresponding one of the set number of the image forming apparatuses.

9. A computer-readable storage medium which, in order to manage a plurality of image forming apparatuses having a plurality of operation modes of different power consumption, stores a program to execute:

a setting procedure to set a greater number of the image forming apparatuses operating in an operation mode of greater power consumption and the smaller number of the image forming apparatuses operating in an operation mode of smaller power consumption, in a time band when the plurality of the image forming apparatuses are used more frequently;

a generating procedure to generate a setting information to set the operation mode executed by the image forming apparatuses in each preset time band, for each of the plurality of the image forming apparatuses; and a transmitting procedure to transmit the setting information generated for each of the image forming apparatuses to a corresponding one of the image forming apparatuses.

10. The storage medium of claim 8, further stores the program to execute;

a requesting procedure to request against the plurality of the image forming apparatuses to report the operation mode of actual operation.

11. The storage medium of claim 8, further stores the program to execute;

an acquiring procedure to acquire a information indicating the operation mode of each of the plurality of the image forming apparatuses in actual operation from each of the image forming apparatuses;

a changing procedure to change the setting information based on the information acquired from the image forming apparatuses; and which transmits the changed setting information to a corresponding one of the image forming apparatuses by the transmitting procedure.

12. The storage medium of claim 8, further stores the program to execute;

an acquiring procedure to acquire a information indicating the operation mode of each of the plurality of the forming apparatuses in actual operation from each of the image forming apparatuses;

a changing procedure to change the number of the image forming apparatuses operating in each time band and the setting information based on the information acquired from the image forming apparatuses; and which transmits each of the changed setting information to the changed number of the image forming apparatuses by the transmitting procedure.

13. An image forming apparatus having a normal mode for operation with normal power consumption and a plurality of power saving modes for operation with smaller power consumption than in the normal mode, comprising:

an acquisition unit which acquires, from an external device, first setting information for setting the normal mode and one of the power saving modes for each time band;

a transmission unit which transmits the operation information indicating the operation mode of actual operation for each time band to the external device; and a control unit which controls the operation of each unit in the operation mode indicated by the first setting information and, if the acquisition unit acquires the second setting information generated newly by the external device based on the operation information, controls the operation of each unit in the operation mode indicated by the second setting information.

14. The apparatus of claim 13, wherein the transmission unit transmits the operation information in response to a request from the external device.

15. The apparatus of claim 13, further comprising:

an operation unit operated by the user; and an interface unit for accepting a network access;

wherein the control unit restores the operation mode from the first power saving mode to the normal mode in response to an access thereto which may occur through the operation unit in the first power saving mode, and maintains the first power saving mode in response to an access thereto which may occur through the interface unit in the first power saving mode.

16. The apparatus of claim 15, wherein the control unit maintains the second power saving mode in spite of an access thereto which may occur through one of the operation unit and the interface unit in the second power saving mode.

17. The apparatus of claim 15, wherein the control unit restores the operation mode from the third power saving mode to the normal mode in response to an access thereto which may occur through one of the operation unit and the interface unit in the third power saving mode.

* * * * *